United States Patent [19]

Bailey et al.

[11] Patent Number: 4,850,421

[45] Date of Patent: Jul. 25, 1989

[54] SHAKING APPARATUS

[75] Inventors: Frank V. Bailey; Lee A. Woodward, both of Racine, Wis.

[73] Assignee: Outboard Marine Corporation, Waukegan, Ill.

[21] Appl. No.: 197,276

[22] Filed: May 23, 1988

Related U.S. Application Data

[60] Division of Ser. No. 838,796, Mar. 12, 1986, Pat. No. 4,766,771, which is a continuation-in-part of Ser. No. 671,629, Nov. 15, 1984, Pat. No. 4,600,046, which is a continuation-in-part of Ser. No. 568,051, Jan. 4, 1984, Pat. No. 4,593,739.

[51] Int. Cl.[4] ..... B22C 15/10; B06B 1/16

[52] U.S. Cl. ..... 164/203; 164/260

[58] Field of Search ..... 164/203, 260

[56] References Cited

U.S. PATENT DOCUMENTS 4,600,046 7/1986 Bailey et al. ..... 164/203

*Primary Examiner*—Nicholas P. Godici
*Assistant Examiner*—Samuel M. Heinrich
*Attorney, Agent, or Firm*—Michael, Best & Friedrich

[57] ABSTRACT

A variably unbalanced rotating mechanism comprising a frame, a main shaft having a longitudinal axis and supported on the frame for rotation about the longitudinal axis, a drive for rotating the main shaft, first and second eccentric weights mounted for rotation coaxially with the main shaft, and a mechanism for rotating the weights in common with the main shaft and for selectively rotating the weights in opposite directions relative to each other and relative to the main shaft and independently of main shaft rotation.

4 Claims, 2 Drawing Sheets

SHAKING APPARATUS

RELATED APPLICATIONS

This application is a division of application Ser. No. 838,796, filed Mar. 12, 1986, now U.S. Pat. No. 4,766,771 which application is a continuation-in-part of earlier application Ser. No. 671,629, now U.S. Pat. No. 4,600,046 filed Nov. 15, 1984, which, in turn, is a continuation-in-part of application Ser. No. 568,051, now U.S. Pat. No. 4,593,739 filed Jan. 4, 1984, which applications are incorporated herein by reference.

BACKGROUND OF THE INVENTION

The invention relates generally to sand compaction apparatus.

The invention also relates to devices for producing unbalanced or shaking forces.

More particularly, the invention relates to sand compaction devices or apparatus including devices for generating shaking forces. Still more particularly, the invention relates to sand compaction apparatus for casting articles from plastic or foam patterns which are embedded in foundry sand and which evaporate upon contact with molten metal.

SUMMARY OF THE INVENTION

The invention provides apparatus for bedding a pattern in a molding flask, which apparatus comprises a flask adapted to receive a pattern to be bedded in sand in the flask, means for filling sand into the flask about the pattern therein, whereby the combined center of mass of the flask, the pattern in the flask, and the sand in the flask moves vertically in response to the filling of sand in the flask, means for shaking the flask during filling of sand into the flask and including a mechanism for creating a generally horizontally directed shaking force, and means for adjustably vertically locating the shaking force generated by the mechanism, whereby to permit location of the shaking force substantially in the horizontal plane containing the combined center of mass of the flask, the pattern in the flask, and the sand in the flask, notwithstanding vertical movement of the combined center of mass.

The invention also provides a variably unbalanced rotating mechanism comprising a frame, a shaft having a longitudinal axis and supported on the frame for rotation, means for rotating the shaft, means on the frame for creating a shaking force in response to shaft rotation, and means for adjustably locating the shaking force axially of the shaft during shaft rotation.

The invention also provides a variably unbalanced rotating mechanism comprising a frame, a shaft having a longitudinal axis and supported on the frame, means for rotating the shaft, means on the frame for creating a shaking force in response to shaft rotation, and means for varying the magnitude of the shaking force during shaft rotation.

In one evidence, the mechanism also includes means for varying the frequency of the shaking force.

The invention also provides a variably unbalanced rotating mechanism comprising a frame, a main shaft having a longitudinal axis and supported on the frame for rotation about the longitudinal axis, means for rotating the main shaft, first and second eccentric weights mounted for rotation in coaxial relation to the main shaft, and means for rotating the weights in common with the main shaft and for selectively rotating the weights in opposite directions relative to each other and relative to the main shaft and independently of main shaft rotation.

In one embodiment of the invention, the means for selectively rotating the weights includes, on each of the weights, respective gears in facing relation to each other, a pinion in meshing engagement with each of the gears and having a rotary axis perpendicular to the longitudinal axis of the main shaft, and means for rotating the pinion in common with the shaft about the longitudinal axis and relative to the main shaft about the rotary axis.

In one embodiment of the invention, the means for rotating the pinion includes a diametric cross bore in the main shaft, a cross shaft fixed to the pinion and rotatably carried in the cross bore, and means for rotating the cross shaft about the rotary axis independently of main shaft rotation.

In one embodiment of the invention, the means for rotating the cross shaft comprises an axial bore located in the main shaft and intersecting the cross bore, an actuator located in the axial bore and movable axially therein, a second pinion on the cross shaft, a rack on the actuator in meshing engagement with the second pinion, and means for displacing the actuator axially of the axial bore, whereby to rotate the cross shaft independently of main shaft rotation, and thereby to rotate the weights in opposite directions relative to each other.

In one embodiment of the invention, the means for displacing the actuator comprises a rotatably driven member, and means connecting the rotatably driven member to the actuator for axially displacing the actuator in response to rotation of the member.

The invention also provides a device for providing a shaking force of adjustable magnitude and location, which device comprises a frame, a main shaft rotatably mounted on the frame and having a longitudinal axis, means for rotating the main shaft, first and second variably unbalanced mechanisms, which first and second mechanisms are respectively located generally in spaced first and second planes and are respectively rotatably carried in coaxial relation to the main shaft, each of which mechanisms includes first and second eccentric weights mounted for rotation in coaxial relation to the main shaft, rotary means for rotating the weights of the first mechanism in common with the rotation of the main shaft and for selectively rotating the weights of the first mechanism in opposite rotary directions independently of rotation in opposite rotary directions of the weights of the second mechanism and independently of rotation of the main shaft, and means for rotating the weights of the second mechanism in common with rotation of the main shaft and for selectively rotating the weights of the second mechanism in opposite rotary directions independently of rotation in opposite rotary directions of the weights of the first mechanism and independently of rotation of the main shaft.

The invention also provides a device for providing a shaking force of adjustable magnitude, which device comprises a frame, first and second main shafts rotatably mounted on the frame in parallel relation to each other and having respective longitudinal axes, means for rotating the first and second main shafts in opposite rotary directions and at a common speed, first and second variably unbalanced mechanisms, which first mechanism is located generally in a first plane and is respectively rotatably carried in coaxial relation to the first main shaft, and which second mechanism is located in the first plane and is respectively rotatably carried in coaxial relation to the second main shaft, each of which mechanisms includes first and second eccentric weights mounted for rotation in coaxial relation to the associated one of the first and second main shafts, and rotary means for respectively rotating the weights of said first and second mechanisms in common with the rotation of the first and second main shafts, and for selectively rotating the weights of the first mechanism in opposite rotary directions relative to the first main shaft and independently of rotation of the first main shaft, and for selectively rotating the weights of the second mechanism in opposite rotary directions relative to the second main shaft and in common with the rotation in opposite rotary directions of the weights of the first mechanism and independently of rotation of the second main shaft.

The invention also provides a device for providing a shaking force of adjustable frequency, magnitude, and location, which device comprises a frame, first and second main shafts rotatably mounted on the frame in parallel relation to each other and having respective longitudinal axes, means for rotating the first and second main shafts in opposite directions and at a common adjustable speed, first, second, third and fourth variably unbalanced mechanisms, which first and second mechanisms are located generally in a first common plane and are respectively rotatably carried in coaxial relation to the first and second main shafts, and which third and fourth mechanisms are located in a second common plane in spaced parallel relation to the first plane and are respectively rotatably carried in coaxial relation to the first and second main shafts, each of which mechanisms includes first and second eccentric weights mounted for rotation in coaxial relation to the associated one of the first and second main shafts, rotary means for respectively rotating the weights of the first and second mechanisms in common with the rotation of the first and second main shafts, and for selectively rotating the weights of the first mechanism in opposite rotary directions relative to the first main shaft and independently of rotation in opposite rotary directions of the weights of the third and fourth mechanisms and independently of rotation of the first main shaft, and for selectively rotating the weights of the second mechanism in opposite rotary directions relative to the second main shaft and in common with the rotation in opposite rotary directions of the weights of the first mechanism and independently of rotation in opposite rotary directions of the weights of the third and fourth mechanisms and independently of rotation of the second main shaft, and rotary means for respectively rotating the weights of the third and fourth mechanisms in common with rotation of the first and second main shafts, and for selectively rotating the weights of the third mechanism in opposite rotary directions relative to the first main shaft and independently of rotation in opposite rotary directions of the weights of the first and second mechanisms and independently of rotation of the first main shaft, and for selectively rotating the weights of the fourth mechanism in opposite rotary directions relative to the second main shaft and in common with the rotation in opposite rotary directions of the weights of the third mechanism and independently of rotation in opposite rotary directions of the weights of the first and second mechanisms and independently of rotation of the second main shaft.

A principal feature of the invention is the provision of a shaking apparatus comprising a variably unbalanced shaking mechanism, and means for varying the magnitude of the shaking force produced by the mechanism. Most importantly, the magnitude of the shaking force can be varied during operation of the shaking apparatus.

Another principal feature of the invention is the provision of means for adjusting the location of the shaking force produced by the apparatus. This adjustment can also be made during operation of the apparatus.

Other features and advantages of the embodiments of the invention will become known by reference to the following general description, claims and appended drawings.

Figure 1:
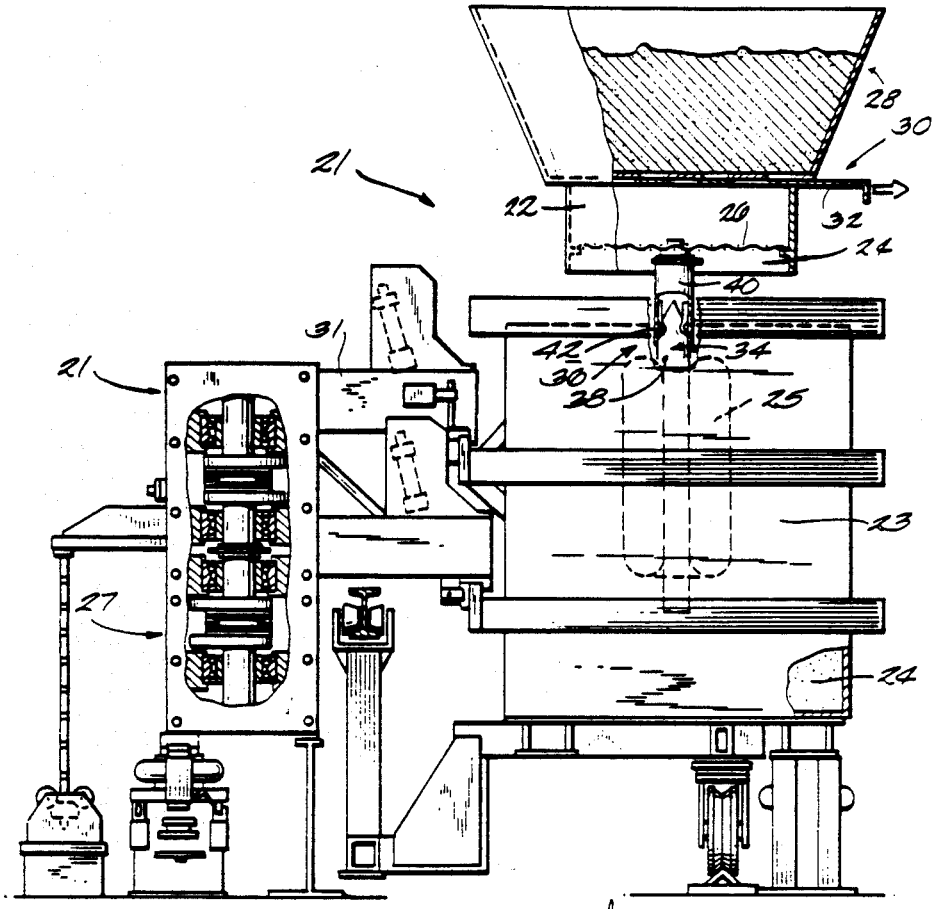
FIG. 1 is a partially broken-away elevational view of one sand compaction apparatus embodying various of the features of the invention.

Before explaining one embodiment of the invention in detail, it is to be understood that the invention is not limited in its application to the details of construction and the arrangement of components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

GENERAL DESCRIPTION

Shown generally in FIG. 1 is a sand compaction apparatus or mechanism 21 which, in general, includes a flask or container 23 for sand 24 which embeds a pattern 25 which is of the lost foam type and which has a sprue 26 extending upwardly therefrom.

The apparatus 10 further includes means for depositing sand in a rainfall into the mold flask 23 to surround and bed the mold pattern 25. While various suitable means could be employed for this purpose, in the illustrated construction, such means comprises a distribution box 22 positioned above the mold flask 23. The distribution box 22 includes means for distributing sand evenly across the mold flask 23 at a controlled velocity. In the illustrated construction, this means is a screen 26 in the bottom end of the distribution box. The sand 24 is sifted through the screen 26 so that it falls in a rainfall, or evenly across the mold flask 23, at a controlled velocity. Such a distribution box 22 and screen 26 are conventional and will not be described in greater detail herein.

Also illustrated in FIG. 1 is a batch hopper 28 positioned above the distribution box 22. The batch hopper 28 is adapted to contain sand and includes selectively operable means 30 for depositing sand into the distribution box 22. This means 30 could be, for example, a sliding door 32 in the bottom end of the batch hopper 28, as shown in FIG. 1. The batch hopper 28 and the selectively operable means 30 are also conventional and will not be described in further detail herein.

The molding apparatus 21 further includes means 34 for holding the mold pattern 25 in a relatively stationary position in the mold flask 23. While other means 34 could be employed, in the preferred embodiment, such means 34 include means 36 attached to the distribution box 22 for releasably clampingly engaging the mold pattern sprue 38. While various suitable clamping means 36 could be employed, in the illustrated construction, the means 36 comprise a generally rigid cylindrical tube 40 attached to the distribution box 22 and extending downwardly therefrom. The lower end of the tube 40 encircles the upper end of the mold pattern sprue 38 and is releasably secured thereto by spring clips 42.

Releasably clamped by suitable means to the flask 23 is a shaking force generator or device 27 which is particularly adapted to produce a single resultant shaking force directed approximately through the center of gravity or mass of the combined flask 23 and sand 24 and pattern 25 contained therein.

When the mold flask 23 contains sand, the mold flask 23, the pattern 25, and the sand have a combined center of gravity. When the mold flask 23 is being filled with sand, the combined center of gravity moves, first down and then back up to the approximate mold flask center as sand is added. Therefore, the combined center of gravity will have high and low extreme locations.

Fuller descriptions of portions of the overall device shown in FIG. 1 can be found in U.S. patent applications Ser. No. 671,629 filed Nov. 15, 1984, and Ser. No. 568,051 filed Jan. 4, 1984 which applications are incorporated herein by reference.

It is desireable to vary the magnitude of the shaking force and the frequency of the application thereof to accommodate patterns of differing complexities. Accordingly, the shaking force generator 27 is arranged to afford variation in the frequency of the shaking force, in the magnitude of the shaking force, and in the vertical location of the shaking force.

While other constructions can be employed, in the disclosed construction, the generator 27 includes a frame 31 and (see FIG. 2) a pair of main shafts 33 and 35 which are rotatably mounted in parallel relation by suitable bearings 37 on the frame 31. While other constructions can be employed, in the disclosed construction, each of the shafts 33 and 35 includes two axially aligned shaft sections 34 and 36 connected by a suitable coupling 38.

The generator 27 also includes means for rotating the shafts in opposite rotary directions and at the same speed. While various arrangements can be employed, as for instance, intermeshing gear arrangements, in the disclosed construction, such means comprises, on the adjacent ends of each of the main shafts 33 and 35, respective timing pulleys 39 and 41 which are of the same diameter and which are interconnected by a timing belt 43. Also included in the disclosed shaft rotating means is an idler pulley 45 which is adjustably and rotatably mounted on the frame 31 by any suitable means. In addition, the shaft rotating means further includes a drive pulley 47 which is fixed on the end of an output shaft 49 of a suitable electric drive motor 51 suitably mounted on the frame 31. Preferably, the drive motor 51 can be adjustably operated to obtain variation in motor speed. In addition, the end of the output shaft 49 is preferably received in a bearing 52 which stabilizes the output shaft 49.

Figure 4:
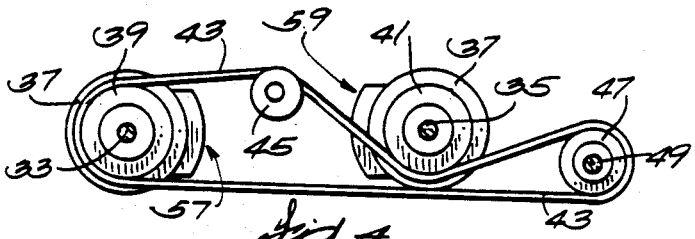
FIG. 4 is an enlarged view taken along line 4—4 of FIG. 2.

The timing belt 43 is trained around the pulleys 39, 41, 45 and 47, as shown in FIG. 4, so that the main shafts 33 and 35 rotate in opposite directions.

Also included in the generator 27 are first, second, third and fourth variably unbalanced mechanisms 53, 55, 57, and 59. While other constructions can be employed, in the illustrated construction, each of the variably unbalanced mechanisms 53, 55, 57, and 59 is generally identically constructed and the first and second mechanisms 53 and 55 are located generally in a first plane 61 perpendicular to the main shafts 33 and 35 and respectively on the main shafts 33 and 35. In addition, the third and fourth mechanisms 57 and 59 are respectively located on the main shafts 33 and 35 and generally in a second plane 63 which is generally parallel to the first plane 61.

As each of the variably unbalanced mechanisms 53, 55, 57 and 59 is generally identically constructed, only the mechanism 53 will be described in detail. The mechanism 53 includes (see FIG. 3) first and second eccentric weights 65 and 67 each including an annular hub portion 69 and a weight portion 71 extending radially outwardly from the hub portion 69 and of suitable size and shape. The weights 65 and 67 are mounted for rotation in coaxial relation to the main shaft 33 and for rotation in opposite directions relative to the main shaft 33 by bearings 73 located between the main shaft 33 and the hub portions 69. In other embodiments, (not shown, weights fixedly mounted to the main shaft 33 can be used in combination with weights mounted for rotation relative to the main shaft 33.

Means are provided for rotating the weights 65 and 67 in common with the main shaft 33, and for selectively rotating the weights 65 and 67 in opposite rotary directions relative to each other and relative to the main shaft 33, and independently of main shaft rotation. By independently of main shaft rotation it is meant that the weights 65 and 67 can be rotated relative to each other and to the main shaft 33 regardless of whether the main shaft 33 is rotating or is not rotating. While various arrangements can be provided, in the illustrated construction, such weight rotation means comprising a pair of gears 75 and 77 which are respectively fixed to the weights 65 and 67, which are located in facing relation to each other and which are thereby rotatable with the weights 65 and 67 about the main shaft 33, together with a pair of pinions 79 which are in meshing engagement with each of the gears 75 and 77 and which are rotatable about a rotary axis 81 perpendicular to the axis of the main shaft 33. In addition, means are provided for rotating the pinions 79 in common with the main shaft 33 about the main shaft axis and relative to the main shaft 33 about the rotary axis 81.

While various pinion rotating means can be employed, in the disclosed construction, such means comprises a diametric cross bore 83 in the main shaft 33, a cross shaft 85 rotatably carried in the cross bore 83, and fixed to the pinions 79, and means for rotating the cross shaft 85 about the rotary axis 81.

While various arrangements can be employed for rotating the cross shaft 85, in the disclosed construction, such means comprises an axial bore 91 which is located in the main shaft 33, which is open at the adjacent end of the main shaft 33, and which intersects the cross bore 83. Located in the axial bore 91 is an axially movable actuator or rod 93 which includes a rack 95 in meshing engagement with a pinion 97 fixed on the cross shaft 85. Thus, axial displacement of the actuator 93 rotates the cross shaft 85 which, in turn, causes pinion rotation which causes rotation of the weights 65 and 67 about the axis of the shaft 33 and in opposite directions relative to each other and to the main shaft 33.

The means for rotating the cross shaft 85 also includes means for axially displacing the actuator or rod 93, whereby to rotate the cross shaft 85 and thereby the weights 65 and 67 independently of main shaft rotation.

While various arrangements can be employed, such as for instance hydraulic or pneumatic or mechanical, in the disclosed construction, such means includes (see FIG. 3) an electric motor 101 including an output shaft 103, and coupling means connecting the output shaft 103 to the actuator 93 to obtain axial actuator movement in response to output shaft rotation.

Figure 3:
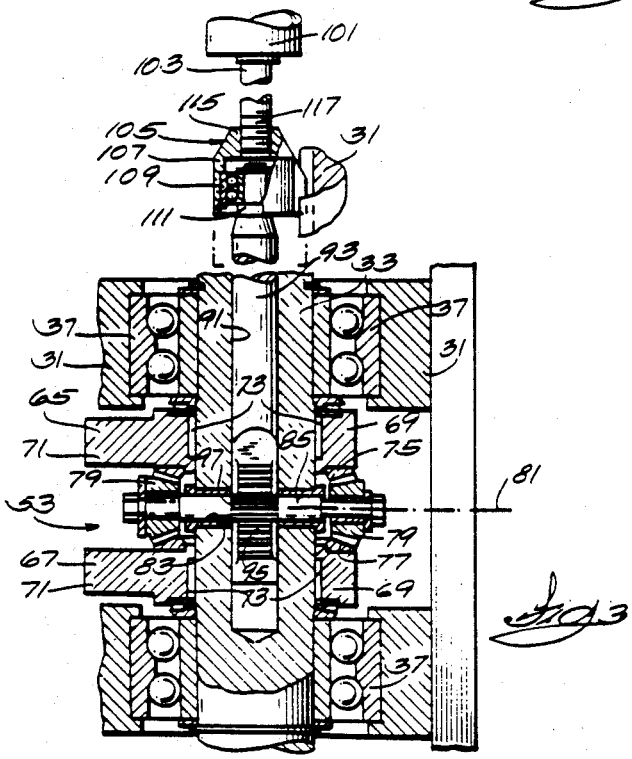
FIG. 3 is an enlarged view of a portion of the sand compaction apparatus shown in FIG. 2.

While various coupling means can be provided, in the construction shown in FIG. 3, such means comprises a socket and nut member 105 which is suitably mounted on the frame 31 for displacement in directions axially of the main shaft 33 and against rotation relative to the frame 31. The socket and nut member 105 includes a socket or recessed portion 107 including bearings 109 which rotatably receive a reduced end portion 111 of the actuator 93 so as to provide for common displacement axially of the main shaft 33 of the actuator 93 and of the socket and nut member 105, thereby permitting rotation of the actuator 93 with the main shaft 33, without causing rotation of the socket and nut member 105 and thereby affording linear displacement of the actuator 93 in response to linear displacement of the socket and nut member 105.

The socket and nut member 105 also includes a nut portion 115 which threadedly receives a threaded portion 117 of the output shaft 103 of the electric motor 101 so as to cause linear displacement of the socket and nut member 105 in response to rotation of the output shaft 103 of the motor 101. Accordingly, rotational operation of the motor 101 causes axial displacement of the actuator 93 which, in turn, causes rotation of the cross shaft 85, and consequent counter rotation of the weights 65 and 67 relative to each other and to the main shaft 33, and independently of main shaft rotation.

Figure 2:
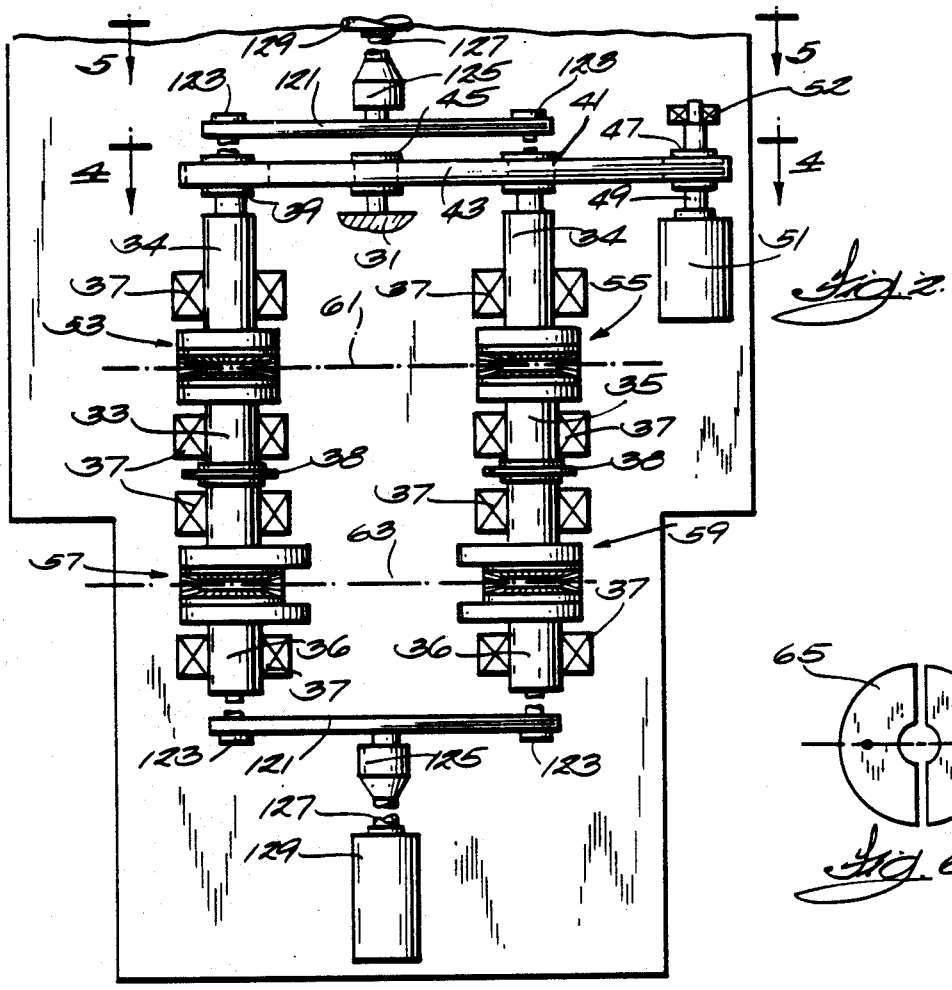
FIG. 2 is a partially schematic view of a portion of the a shown in FIG. 1.

The arrangement disclosed immediately above can be employed for axial displacement of a single actuator 93 and one such arrangement or mechanism can be employed for lineraly displacing each actuator 93. However, it is preferred, as shown in FIG. 2, to employ first or upper means for selectively linearly displacing, in unison, the actuators 93 of the first and second mechanisms 53 and 55 independently of linear displacement of the actuators associated with the third and fourth mechanisms 57 and 59, and second or lower means for selectively linearly displacing, in unison, the actuators associated with the third and fourth mechanisms 57 and 59 independently of the actuators 93 of the first and second mechanisms 53 and 55.

While other arrangements can be employed, in the disclosed construction, the upper means for linearly displacing, in unison, the actuators 93 of the first and second mechanisms 53 and 55 and the lower means for linearly displacing, in unison, the actuators of the third and fourth mechanisms 57 and 59 are generally identically constructed and, accordingly, only the upper means for simultaneously displacing the actuators 93 of the first and second mechanisms 53 and 55 will be explained in detail.

While other constructions could be employed, in the disclosed construction, this means for simultaneously causing linear displacement of the actuators 93 of the first and second mechanisms 53 and 55 comprises a cross member 121 which, at each end, includes socket portions 123 which correspond to the socket portion 107 already described and which are respectively coupled to the actuators of the first and second mechanisms 53 and 55 to enable common linear displacement of the actuators 93 and the cross member 121 and to permit rotation of the actuators 93 relative to the cross member 121.

Intermediate the ends of the cross member 121, the cross member 121 includes a nut portion 125 which corresponds to the nut portion 115 already described and which threadably receives the output shaft 127 of an electric motor 129 corresponding to the motor 101 already described. As the connection of the cross member 121 to the actuators 93 prevents rotation of the cross member 121 about the axis of the motor output shaft 127, rotation of the motor output shaft 127 causes linear displacement of the cross member 121 and actuators 93 which, as already explained, results in rotation of the weights 65 and 67 in opposite rotary directions.

From the foregoing, it is apparent that adjustment of the speed of the drive electric motor 51 will vary the frequency of the shaking force created by the generator 27.

Figure 6:
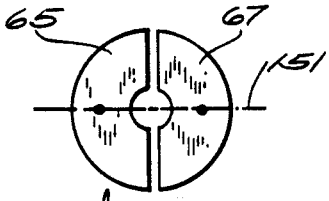
FIGS. 6, 7 and 8 are schematic views of the relative positions of the weights incorporated in the apparatus as shown in FIG. 3.
Figure 7:
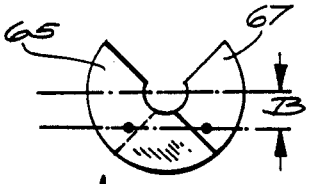
Figure 8:
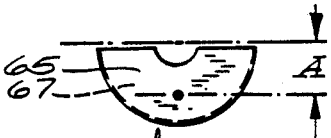
Figure 5:
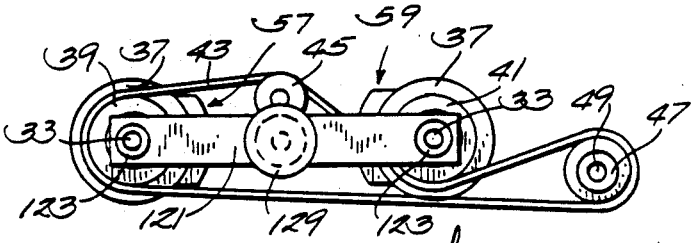
FIG. 5 is an enlarged view taken along line 5—5 of FIG. 2.

Referring to FIGS. 6 through 8, when the weights 65 and 67 are located as shown in FIG. 6, with minimum overlap and with the centers of mass of the weights in a common plane 151 including the center line or longitudinal axis of the associated main shaft, the magnitude of the resulting shaking force will be at a minimum.

When the weights 65 and 67 are rotated to the relative positions shown in FIG. 8, wherein the weights are located in maximum overlap and with the centers of mass of the weights 65 and 67 aligned and located at a distance "A" from the longitudinal axis of the associated main shaft, the magnitude of the shaking force will be at a maximum.

When the weights 65 and 67 are rotated to intermediate relative positions, as shown in FIG. 7, the combined center of mass is effectively located at a distance B from the main shaft center line and thus the shaking force has an intermediate magnitude.

Thus, by rotating the weights 65 and 67 relative to each other, the magnitude of the individual shaking force of each of the mechanisms 53, 55, 57 and 59 can be varied. Because the first and second unbalanced mechanisms 53 and 55 are located in a common plane, they create a common resultant shaking force.

Because the first and second planes 61 and 63 are parallel to each other, the common resulting shaking force in each plane has the effect of an overall combined or unified single resulting shaking force located in a third plane between the first and second planes 61 and 63.

Because the magnitude of the common resulting shaking forces in each of the first and second planes can be varied from minimum to maximum, it is possible to variably vertically locate the overall combined or unified single resulting shaking force, and thereby to maintain, as close as reasonably possible, location of the overall combined or unified single resulting shaking force in a plane which also contains the combined center of gravity of the flask 23, the sand 24, and the pattern 25.

In this regard, if the first and second mechanisms 53 and 55 are actuated so as to provide a common resulting shaking force in the first plane 61 of a minimum magnitude, and the third and fourth mechanisms 57 and 59 are actuated to provide a common resulting shaking force in the second plane 63 of maximum magnitude, the overall combined or unified single resulting shaking force will be located near the second plane 63 and have a magnitude somewhat greater than the magnitude of the common resulting shaking force generated by the third and fourth mechanisms 53 and 57. Furthermore, if the mechanisms are actuated to generate maximum magnitude common resulting forces in each of the first and second planes 61 and 63, then the overall combined or unified single resulting shaking force will be twice the magnitude of each of the common single plane resulting shaking forces and will be located in a third plane midway between the first and second planes 61 and 63. Thus, by variably adjusting the weights 65 and 67 of the first and second mechanisms 53 and 55, and by variably adjusting the weights 65 and 67 of the third and fourth mechanisms 57 and 59, the magnitude of the common resulting shaking forces generated respectively in the first and second planes 61 and 63 can be varied, whereby both the magnitude and the vertical location of the overall combined or unified single resulting shaking force can be controlled.

While the full advantages of the invention can be obtained when using the two-shaft, four-mechanism arrangement shown in FIG. 2, at least some of the advantages of the invention can be obtained when using only a single unbalanced mechanism on a single shaft, or when using a single unbalanced mechanism on each of two parallel main shafts, or by using two unbalanced mechanisms on a single shaft.

Furthermore, while the disclosed construction is particularly applicable with respect to sand compacting apparatus, various of the features of the invention are also applicable to changing the valve timing overlap in four-stroke engines, and may also be applicable in other areas.

It is of particular significance, as already pointed out, that the disclosed apparatus enables changes or adjustments in the frequency, magnitude, and location of the overall combined or unified single resulting shaking force without stopping rotation of the main shafts 33 and 35.

Various of the features of the invention are set forth in the following claims.

I claim:

1. Apparatus for bedding a pattern in a molding flask, said apparatus comprising a flask adapted to receive a pattern to be bedded in sand in said flask, means for filling sand into said flask about the pattern therein, whereby the combined center of mass of said flask, the pattern in said flask, and the sand in said flask moves vertically in response to the filling of sand in said flask, and means for applying to said flask, during filling of sand thereinto, a generally horizontally directed shaking force, and for adjustably vertically locating the shaking force, said means for applying and adjustably locating the shaking force comprising first and second pairs of eccentric weights rotatable about a common axis, and in common with each other, and located in axially spaced relation to each other, said eccentric weights in each of said pairs being angularly adjustable relative to each other, and means for selectively angularly adjusting said eccentric weights of one of said first and second pairs independently of the angular adjustment of said eccentric weights in the other of said first and second pairs and without interruption in the common rotation of said eccentric weights, whereby to permit location of the shaking force substantially in the horizontal plane containing the combined center of mass of said flask, the pattern in said flask, and the sand in said flask, notwithstanding vertical movement of said combined center of mass.

2. Apparatus in accordance with claim 1 wherein said means for applying and adjustably locating the generally horizontally directed shaking force also includes means for varying the frequency of the shaking force.

3. Apparatus in accordance with claim 1 wherein said means for applying and adjustably locating the generally horizontally directed shaking force also includes means for varying the magnitude of the shaking force.

4. Apparatus in accordance with claim 1 wherein said means for applying and adjustably locating the generally horizontally directed shaking force also includes means for varying the magnitude of the shaking force and for varying the frequency of the shaking force.

* * * * *